US007332461B2

(12) United States Patent
Eastwood

(10) Patent No.: US 7,332,461 B2
(45) Date of Patent: Feb. 19, 2008

(54) ANIONIC SURFACTANTS

(75) Inventor: John Eastwood, Billingham (GB)

(73) Assignee: Croda International PLC, Goole, East Yorkshire (GB)

( * ) Notice: Subject to any disclaimer, the term of this patent is extended or adjusted under 35 U.S.C. 154(b) by 526 days.

(21) Appl. No.: 10/640,398

(22) Filed: Aug. 14, 2003

(65) Prior Publication Data

US 2004/0152606 A1 Aug. 5, 2004

Related U.S. Application Data

(63) Continuation of application No. PCT/GB02/00451, filed on Feb. 1, 2002.

(30) Foreign Application Priority Data

Feb. 15, 2001 (GB) ..... 0103724.1

(51) Int. Cl.
*C10M 105/34* (2006.01)
*C10M 173/02* (2006.01)
*B21B 45/02* (2006.01)

(52) U.S. Cl. ..... 508/463; 508/390; 508/421; 508/501; 508/505; 508/579; 508/589; 72/42

(58) Field of Classification Search ..... 508/478, 508/479, 463, 501; 72/42
See application file for complete search history.

(56) References Cited

U.S. PATENT DOCUMENTS

| | | | | |
|---|---|---|---|---|
| 2,351,280 | A | 6/1944 | Morgan | |
| 3,228,880 | A | 1/1966 | Roberts et al. | |
| 3,917,447 | A | 11/1975 | Lazar et al. | |
| 3,932,128 | A | 1/1976 | Beaulieu | |
| 3,945,930 | A * | 3/1976 | Sugiyama et al. | 508/431 |
| 3,953,344 | A * | 4/1976 | Narushima | 508/408 |
| 4,366,077 | A * | 12/1982 | Andrew et al. | 508/176 |
| 4,606,833 | A * | 8/1986 | Schuettenberg et al. | 508/431 |
| 4,618,441 | A * | 10/1986 | Tsai | 508/501 |
| 5,068,049 | A * | 11/1991 | Hatano et al. | 508/481 |
| 5,417,725 | A * | 5/1995 | Graves | 44/388 |
| 5,616,544 | A * | 4/1997 | Kalota et al. | 508/508 |
| 7,008,909 | B2 * | 3/2006 | Burgo et al. | 508/463 |

FOREIGN PATENT DOCUMENTS

| | | |
|---|---|---|
| EP | 0 664 331 A1 * | 7/1995 |
| EP | 1154011 A1 | 11/2001 |
| GB | 2089369 | 6/1982 |
| JP | 55-23132 | 2/1980 |

* cited by examiner

*Primary Examiner*—Ellen McAvoy
(74) *Attorney, Agent, or Firm*—Jones Day

(57) ABSTRACT

A lubricant composition for metal forming and cutting has at least one compound of the formula (I): $R_1$—$(AO)_n$—OOC—$(CH_2)_m$—Ph—$(R^2)_p$ where $R^1$ is a $C_1$ to $C_{15}$ alkyl group AO is an alkyleneoxy group which may vary along the (poly) alkylenoxy chain; n is 0 or from 1 to 100; m is 0, 1 or 2; and Ph is a phenly group, which may be substituted with groups $(R^2)_p$; where each $R^2$ is independently an alkyl, halogen, haloalky or alkoxy group; and p is 0 or from 1 to 3. The lubricant composition also includes at least one lubricant additive selected from the group consisting of an organic ester additive, a polyalkylene glycol additive, a sulphur-containing synthetic additive, a sulphur-containing oleochemical additive, a suiphonate, a phosphorus-containing additive and a chlorinated paraffin additive. Also described are a method of using the lubricant composition in metal forming and cutting applications and the use of the lubricant composition in metal forming and cutting applications. The lubricant composition may also be used in water-based compositions for such applications.

14 Claims, No Drawings

ANIONIC SURFACTANTS

CROSS REFERENCE TO RELATED APPLICATION

This application is a continuation application based on International Application No. PCT/GB02/00451, filed Feb. 1, 2002, which designates the United States. This application, in its entirety, is incorporated herein by reference.

The present invention relates to a metal forming and metal cutting lubricant composition and a method of forming and cutting a metal using such a composition.

Metal forming and metal cutting are well-known metal working application areas. Metal forming operations include blanking, drawing, ironing, wire drawing, punching, stamping, form rolling, coining and swaging. Metal cutting operations include broaching, tapping, reaming, drilling, milling, turning, grinding and honing.

Petroleum mineral oils, for example paraffinic and naphthenic oils, are extensively used in lubricant compositions in a variety of metal forming and cutting applications. They can be used as neat oils; soluble oils, where emulsifier is present to allow for the dilution of the product into water; and in semisynthetics, where the mineral oil level is typically less than 30% of the total lubricant. When used as neat oils, their lubricant properties may be enhanced by the addition of defined lubricant additives. Examples of lubricant additives that have been used include polyalkylene glycols, which have been shown to provide an increase in fluid performance of the mineral oil. Esters have been shown to aid the reduction of interfacial tension between the oil and metal surface hence increasing the ability of the fluid to penetrate between workpiece and tool and also to provide boundary lubrication.

Extreme pressure lubrication has been shown to be provided by sulphur-containing synthetic, sulphur-containing oleochemical, sulphonates, phosphorus-containing and chlorinated paraffin lubricant additives.

One disadvantage with using mineral oils is disposal of the waste oil and/or spillages as the mineral oil is not biodegradable.

Historically mineral oils were used in lubricant compositions for use in compressors with chlorofluorocarbon (CFC) and hydrochlorofluorocarbon (HCFC) refrigerant gases. In recent years, legislation has dictated a move away from such traditional refrigerant gases to alternatives having lower or zero ozone depletion potential, such as hydrofluorocarbon gases (HFC). This change in refrigerant gas has necessitated a change in compressor lubricant compositions away from mineral oils, which are not compatible with these new HFC gases. It follows that, owing to the presence of residual mineral oil, the use of mineral oil based metal forming and cutting lubricant compositions in such applications is not desirable.

Hence, alternative metal forming and cutting lubricant compositions are being sought.

Accordingly in a first aspect the present invention provides a lubricant composition for metal forming and cutting applications, which comprises a) at least one compound of the formula (I):

$$R^1—(AO)_n—OOC—(CH_2)_m—Ph—(R^2)_p \quad (I)$$

where $R^1$ is a $C_1$ to $C_{15}$ alkyl group

AO is an alkyleneoxy group which may vary along the (poly)alkyleneoxy chain;

n is 0 or from 1 to 100;

m is 0, 1 or 2; and

Ph is a phenylene group, which may be substituted with groups $(R^2)_p$; where each $R^2$ is independently an alkyl, halogen, haloalky or alkoxy group; and p is 0 or from 1 to 3;

and b) at least one lubricant additive selected from the group consisting of an organic ester additive, a polyalkylene glycol additive, a sulphur-containing synthetic additive, a sulphur-containing oleochemical additive, a sulphonate, a phosphorus-containing additive and a chlorinated paraffin additive.

For the compound of formula (I) $R^1$ may be a branched or straight chained alkyl group, preferably a branched alkyl group and it may be saturated or unsaturated. $R^1$ preferably ranges from a C1 to C10 alkyl group; more preferably from a C2 to C8 alkyl group. Examples of $R^1$ include straight-chained alkyls and iso butyl and tertiary alkyls. $R^1$ is preferably nonyl, 2-ethyl hexyl, hexyl, tert-butyl, iso-butyl, sec-butyl, iso-propyl, propyl ethyl or methyl and more preferably 2-ethylhexyl, isobutyl or iso-propyl.

Although the carboxylic acid used in the compound of formula (I) can be a dihydrocinnamic acid or a phenylacetic acid, it is preferably a benzoic acid i.e. desirably m is 0, and, preferably is an unsubstituted acid, i.e. desirably p is 0. AO is particularly an ethyleneoxy or a propyleneoxy group, and may vary along the (poly)alkyleneoxy chain. When present the (poly)alkyleneoxy chain is desirably a (poly)ethyleneoxy, a (poly)propyleneoxy chain or a chain including both ethyleneoxy and propyleneoxy residues. When present n is preferably from 1 to 20. Preferable alkoxylate esters are benzoate esters of diethyleneglycol monomethylether, decaethyleneglycol monomethylether (i.e. 10 ethylene oxide units) and C9/C11 monohydric alcohol ethoxylated with 2.5 ethylene oxide units.

Generally, in preferred compounds of formula (I) n is 0.

When n is 0 the ester of formula (I) is most preferably iso-propyl benzoate, isobutyl benzoate or 2-ethyl hexyl benzoate.

The at least one lubricant additive is selected from the group consisting of an organic ester additive, a polyalkylene glycol additive, a sulphur-containing synthetic additive, a sulphur-containing oleochemical additive, a sulphonate, a phosphorus-containing additive and a chlorinated paraffin additive.

The organic ester lubricant additive is derived from the reaction of at least one alcohol with at least one carboxylic acid.

The at least one alcohol may be a monohydric alcohol or a polyhydric alcohol.

The monohydric alcohol may have a linear and/or branched hydrocarbon chain and may be aliphatic or aromatic. Examples of monohydric alcohols include methanol, ethanol, propanol, iso-propanol, butanol, iso-butanol, tert-butanol, pentanol, hexanol, heptanol, octanol, iso-octanol, 2-ethyl hexanol, nonanol, isononanol, 3,5,5, trimethyl hexanol, decanol, undecanol, dodecanol, tridecanol, lauryl alcohol, cetyl alcohol, stearyl alcohol, oleyl alcohol.

The polyhydric alcohol may be a diol, triol, tetraol and/or related dimers and trimers. Examples are neopentyl glycol, glycerol, trimethylolethane, trimethylolpropane, trimethylolbutane, pentaerythritol, dipentaerthyritol and tripentaerythritol.

The at least one carboxylic acid may be saturated or unsaturated with a linear and/or branched chain. It may be a monocarboxylic acid and/or a polycarboxylic acid or an esterifiable derivative thereof, for example an anhydride. It may be a natural or synthetic monocarboxylic acid and may be aliphatic or aromatic. Preferably the carboxylic acid has C1-C24 alkyl groups. Examples of monocarboxylic acids include propanoic, isopropanoic, butanoic, isobutanoic, pentanoic, isopentanoic, neopentanoic, hexanoic, isohexanoic, 2-ethylbutanoic, heptanoic, 2-methylhexanoic, isoheptanoic, neoheptanoic, octanoic, isooctanoic, 2-ethylhexanoic, nonanoic, isononanoic, 3,5,5,-trimethylhexanoic, decanoic, isodecanoic, neodecanoic, lauric, myristic, palmitic, palmitoleic, margaric, stearic, isostearic, oleic, linoleic, linolenic, nonadecanoic, erucic, behenic acids and mixtures thereof. Examples of dicarboxylic acids include succinic, glutaric, adipic, sebacic, phthalic, isophthalic and terephthalic acids and dimer acid. Examples of tricarboxylic acids include trimellitic acid and trimer acid.

Suitable polyalkylene glycols for the lubricant additives include alcohol-initiated polyalkylene glycols. A monohydric alcohol or a polyhydric alcohol may initiate such polyalkylene glycols. The monohydric alcohol initiator may be straight chained or branched and has between 1 and 20 carbon atoms. The monohydric alcohol may be a mixture of alcohols, for example a mixture of C13/C15 monohydric alcohols. The polyhydric alcohol initiator may a diol, triol, tetraol and/or related dimers and trimers. Examples are water, ethylene glycol, propylene glycol, neopentyl glycol, glycerol, trimethyrolethane, trimethylolpropane, trimethylolbutane, pentaeryhritol, dipentaerthyritol and tripentaerythritol.

The polyalkylene glycol may contain a single type of alkylene oxide, preferably having between 1 and 4 carbon atoms, or a combination of alkylene oxides. When the polyalkylene glycol contains a single type of alkylene oxide, the alkylene oxide is preferably ethylene oxide or propylene oxide, in particular propylene oxide. When the polyalkylene glycol contains a combination of alkylene oxides, the combination of alkylene oxides may be such that a block, random or a block/random polyalkylene glycol copolymer may be formed. The combination of alkylene oxides is preferably a combination of ethylene oxide and propylene oxide. Preferably the combination of ethylene oxide and propylene oxide is such that the propylene oxide is at least 50%, more preferably at least 70%, even more preferably at least 80% of the combination.

The molecular weight of the polyalkylene glycol ranges from 400 to 40,000 more preferably from 400 to 10,000. The polyalkylene glycol may be endcapped, for example etherified or esterified to low residual hydroxyl levels. Suitable etherfied end capping groups include alkyl, for example methyl, ethyl, propyl, isopropyl and butyl, and aryl. Suitable esterified end capping groups include propanoic, isopropanoic, butanoic, isobutanoic, pentanoic, isopentanoic, neopentanoic, hexanoic, isohexanoic, 2-ethylbutanoic, heptanoic, 2-methylhexanoic, isoheptanoic, neoheptanoic, octanoic, isooctanoic, 2-ethylhexanoic, nonanoic, isononanoic, 3,5,5,-trimethylhexanoic, decanoic, isodecanoic, neodecanoic, lauric, myristic, palmitic, palmitoleic, margaric, stearic, isostearic, oleic, linoleic, linolenic, nonadecanoic, erucic and behenic acids.

Sulphur-containing synthetic additives include sulphurised olefins, aryl-polysulphides, alkyl-polysulphides, dithiophosphates (organic or metal containing), dithiocarbamates, sulphurised terpenes and aromatic phosphorthionates.

Examples of suitable sulphur-containing olechemical additives include sulphurised natural oils and fats, sulphurised fatty acids and sulphurised esters.

An example of a sulphonate is calcium sulphonate.

Phosphorus-containing additives, which may be used, include phosphate esters, phosphite esters and amine phosphate esters.

The lubricant additive may be a blend of any of the lubricant additives disclosed. More than one lubricant additive may be present in the lubricant composition. For example the lubricant composition may comprise a blend of a polyalkylene glycol additive and an organic ester additive, or a blend of an organic ester additive and a phosphorus-containing additive or a blend of an organic ester additive and a chlorinated paraffin additive.

The lubricant composition has a kinematic viscosity at 40° C. from 1 to 40 cSt, more preferably 1 to 25 cSt.

The ratio of the compound of formula (I) to lubricant additive is preferably 98:2 to 50:50, more preferably 95:5 to 70:30 and desirably 95:5 to 80:20 in the metal forming and cutting lubricant composition. The metal forming and cutting lubricant composition may further comprise other ingredients commonly used and known to those skilled in the art and especially those selected from other synthetic esters, surfactants, emulsifiers, corrosion inhibitors, anti-oxidants, anti-wear/EP-agents and anti-foaming agents. The total amount of such other ingredients in general is less than 70% by weight calculated on the total lubricant composition.

In a second aspect the present invention provides a method of metal forming and cutting using a lubricant composition which comprises a) at least one compound of the formula (I):

$$R^1—(AO)_n—OOC—(CH_2)_m—Ph—(R^2)_p \quad (I)$$

where $R^1$ is a $C_1$ to $C_{15}$ alkyl group

AO is an alkyleneoxy group which may vary along the (poly)alkyleneoxy chain;

n is 0 or from 1 to 100;

m is 0, 1 or 2; and

Ph is a phenylene group, which may be substituted with groups $(R^2)_p$; where each $R^2$ is independently an alkyl, halogen, haloalky or alkoxy group; and p is 0 or from 1 to 3;

and b) at least one lubricant additive selected from the group consisting of an organic ester additive, a polyalkylene glycol additive, a sulphur-containing synthetic additive, a sulphur-containing oleochemical additive, a sulphonate, a phosphorus-containing additive and a chlorinated paraffin additive.

Forming and cutting speeds and pressures vary considerably depending on the requirement of the application. For example forming pressures can typically be about 100 tes and speeds in grinding can typically be 3000-5000 rpm.

In a third aspect the present invention provides for use of a lubricant composition which comprises a) at least one compound of the formula (I):

$$R^1—(AO)_n—OOC—(CH_2)_m—Ph—(R^2)_p \quad (I)$$

where $R^1$ is a $C_1$ to $C_{15}$ alkyl group

AO is an alkyleneoxy group which may vary along the (poly)alkyleneoxy chain;

n is 0 or from 1 to 100;

m is 0, 1 or 2; and

Ph is a phenylene group, which may be substituted with groups $(R^2)_p$; where each $R^2$ is independently an alkyl, halogen, haloalky or alkoxy group; and p is 0 or from 1 to 3;

and b) at least one lubricant additive selected from the group consisting of an organic ester additive, a polyalkylene glycol additive, a sulphur-containing synthetic additive, a sulphur-containing oleochemical additive, a sulphonate, a phosphorus-containing additive and a chlorinated paraffin additive in metal forming and cutting applications.

The lubricant composition may be used also in water-based compositions, known in the art as synthetic compositions. In the water-based compositions the percentage of lubricant composition typically ranges from 1 to 15% by weight.

Use of the lubricant composition as above may further comprise other ingredients commonly used and known to those skilled in the art and especially those selected from other synthetic esters, surfactants, emulsifiers, corrosion inhibitors, anti-oxidants, anti-wear/EP-agents, biocides and anti-foaming agents. The total amount of such other ingredients in general is less than 70% by weight calculated on the total lubricant composition.

In a fourth aspect the present invention provides for use of a lubricant composition which comprises a) at least one compound of the formula (I):

$$R^1—(AO)_n—OOC—(CH_2)_m—Ph—(R^2)_p \quad (I)$$

where $R^1$ is a $C_1$ to $C_{15}$ alkyl group

AO is an alkyleneoxy group which may vary along the (poly)alkyleneoxy chain;

n is 0 or from 1 to 100;

m is 0, 1 or 2; and

Ph is a phenylene group, which may be substituted with groups $(R^2)_p$; where each $R^2$ is independently an alkyl, halogen, haloalky or alkoxy group; and p is 0 or from 1 to 3;

and b) at least one lubricant additive selected from the group consisting of an organic ester additive, a polyalkylene glycol additive, a sulphur-containing synthetic additive, a sulphur-containing oleochemical additive, a sulphonate, a phosphorus-containing additive and a chlorinated paraffin additive in a water-based metal forming and cutting solution.

The lubricant compositions of the present invention have improved lubricity and are biodegradable. They are miscible with HFC refrigerant gases typically used, for example 1,1,1,2-tetrafluoroethane (R-134a) which has found widespread use as a replacement refrigerant for the chlorine-containing refrigerant gas dichlorodifluoromethane (R-12).

The lubricant compositions of the present invention may be used in a variety of metal forming and cutting applications. Examples are forming of aluminium fins for use in domestic refrigeration, industrial refrigeration and automotive air conditioning systems, drawing of copper pipes for use in refrigeration systems, machining of components used in the manufacture of compressors used in refrigeration systems, industrial refrigeration, industrial, commercial and automotive air conditioning systems, forming of body panels for the car industry, forming of metal components for the electronics industry The invention will be further illustrated by reference to the following examples.

EXAMPLE ONE

Table One illustrates the physical properties of 2-ethylhexyl benzoate, isopropyl benzoate and benzoate ester of diethyleneglycol monomethylether which all fall within the definition of formula (1) of the present invention.

TABLE ONE

| Physical Property | 2-ethylhexyl benzoate | 2-isopropyl benzoate | benzoate ester of diethyleneglycol monomethylether |
|---|---|---|---|
| Viscosity @ 40° C. ($mm^2/s$) (ASTM D445) | 4.10 | 1.70 | |
| Density @ 20° C. ($g/cm^3$) (ASTM D1298) | 0.9681 | 1.0091 | |
| Miscibility (R134a 10%) (° C.) (DIN 51351) | −21 | −9 | −70 |
| Flash Point (° C.) (ASTM D92) | 157 | 99 | |

R134a is 1,1,1,2-tetrafluoroethane available ex Ineos Fluor

Table Two illustrates the physical properties of a neat oil which is not according to formula (1) of the invention, Isopar H—a mineral oil base fluid ex EXXON/Mobil.

TABLE TWO

| Physical Property | Isopar H | Standard Test Method |
|---|---|---|
| Viscosity @ 40° C. ($mm^2/s$) | 1.20 | ASTM D445 |
| Density @ 20° C. ($g/cm^3$) | 0.761 | ASTM D1298 |
| Miscibility (R134a 10%) (° C.) | Immiscible | DIN 51351 |
| Flash Point (° C.) | 66 | ASTM D92 |

The esters according to formula (1) of the present invention have improved physical properties, in particular miscibility in R134a and flashpoint, as compared to neat mineral oils.

EXAMPLE TWO

The lubricity of various lubricant compositions of the present invention was determined using one of two Falex machine tests. Test A consisted of running a rotating steel journal against two stationary steel V-blocks immersed in 80-100 mls lubricant composition at ambient temperature. Increasing loads (in steps of 250 lbs. followed by 5 min constant load at each load) were applied to the V-blocks and maintained by a ratchet mechanism (five minutes for each load). Test B consisted of running a rotating steel journal against two stationary steel V-blocks immersed in 150 mls lubricant composition at ambient temperature. An initial load of 250 lbs. for 5 mins, followed by increasing loads in steps of 250 lbs were applied to the V-blocks. The torque created for each increase in load was measured via a chart recorder. The results are illustrated in Table Three.

TABLE THREE

| Lubricant Composition | Load At Failure (lbs.) (Test Method) | Time to Fail at Failure Load (secs) | Temperature at Failure (° C.) | Kinematic Viscosity at 40° C. |
|---|---|---|---|---|
| 2-ethylhexyl benzoate (92%) with P1564[1)] (8%) | 934 (B) | Not measured | Not measured | 4.01 |

TABLE THREE-continued

| Lubricant Composition | Load At Failure (lbs.) (Test Method) | Time to Fail at Failure Load (secs) | Temperature at Failure (° C.) | Kinematic Viscosity at 40° C. |
|---|---|---|---|---|
| 2-ethylhexyl benzoate (92%) with P3986[2] (8%) | 1052 (B) | Not measured | Not measured | 11.32 |
| 2-ethylhexyl benzoate (92%) with Monalube 205[3] (8%) | 2464 (B) | Not measured | Not measured | 4.78 |
| 2-ethylhexyl benzoate (92%) with TPS 20[4] (8%) | 1161 (B) | Not measured | Not measured | 4.42 |
| 2-ethylhexyl benzoate (92%) with Cereclor E50[5] (8%) | >3000 (B) | Not measured | Not measured | 4.59 |
| 2-ethylhexyl benzoate (92%) with P3986 (4%) and Monalube 205 (4%) | >3000 (B) | Not measured | Not measured | 7.58 |
| 2-ethylhexyl benzoate (92%) with P3986 (4%) and TPS 20 (4%) | >3000 (B) | Not measured | Not measured | 7.40 |
| 2-ethylhexyl benzoate (85%) with P1530[6] (15%) | 1000 (A) | 14 | 70.6 | 3.95 |
| 2-ethylhexyl benzoate (85%) with EMKAROX VG145[7] (15%) | 1000 (A) | 48 | 74.6 | 7.45 |
| isopropyl benzoate (85%) with P1530 (15%) | 1750 (A) | 10 | 154 | 1.95 |

[1]P1564 is a fatty acid ester ex Uniqema, a Business of Imperial Chemical Industries.
[2]P3986 is a fatty acid ester ex Uniqema.
[3]Monalube 205 is a phosphate ester ex Uniqema.
[4]TPS 20 is a sulphurised olefin ex Atofina.
[5]Cereclor C50 is a chlorinated paraffin ex Ineos Fluor.
[6]P1530 is a fatty acid ester ex Uniqema.
[7]EMKAROX VG 145 is an alcohol initiated polyalkylene glycol ex Uniqema.

Table Four illustrates the lubricity of lubricant compositions not according to the present invention

TABLE FOUR

| Lubricant Composition (Comparative) | Load At Failure (lbs.) | Time to Fail at Failure Load (secs) | Temperature at Failure (° C.) | Kinetic Viscosity at 40° C. |
|---|---|---|---|---|
| isopropyl benzoate | 750 (A) | 36 | 68.2 | 1.68 |
| 2-ethylhexyl benzoate | 750 (A) | 23 | 54.7 | 3.86 |
| Isopar H | 250 (A) | 1 | 22.4 | 1.18 |
| Isopar H (92%) with 2-ethylhexyl benzoate | <250 (B) | Not measured | Not measured | 1.24 |
| Isopar H (85%) with P1530 (15%) | 500 (A) | 32 | 37.2 | 1.42 |

The lubricant compositions according to the present invention in Table Three show improved lubricity with respect to the comparative compositions of Table Four.

EXAMPLE THREE

The lubricity of various ethoxylated lubricant compositions of the present invention was determined using the Falex machine Test B as described in Example Two. The results are illustrated in Table Five.

TABLE FIVE

| Lubricant Composition | Load At Failure (lbs.) |
|---|---|
| benzoate ester of diethyleneglycol monomethylether, (92%) with P3986 (4%) and Monalube 205 (4%) | >3000 |
| benzoate ester (92%) of C9/C11 monohydric alcohol ethoxylated with 2.5 ethylene oxide units. with P3986 (4%) and Monalube 205 (4%) | 2556 |

Table Six illustrates the lubricity of-ethoxylated lubricant compositions not according to the present invention, according to Falex Test B.

TABLE SIX

| Lubricant Composition | Load At Failure (lbs.) |
|---|---|
| benzoate ester of diethyleneglycol monomethylether | 1196 |
| benzoate ester of C13/C15 monohydric alcohol ethoxylated with 2.5 ethylene oxide units. | 1034 |

The lubricant compositions according to the present invention in Table Five show improved lubricity with respect to the comparative compositions of Table Six.

EXAMPLE FOUR

The lubricity of various water-based compositions of the present invention was determined using the Falex machine Test B as described in Example Two. The compositions themselves are illustrated in Table Seven.

TABLE SEVEN

| | Lubricant Composition | | | |
|---|---|---|---|---|
| | L1 | L2 | L3 | L4 |
| 2 ethylhexyl benzoate | 65.56% | 60.00% | 60.00% | 60.00% |
| Synperonic A11[8] | 32.56% | 32.56% | 32.56% | 32.56% |
| Synperonic A50[9] | 0.77% | 0.77% | 0.77% | 0.77% |
| P3896 | | 5.56% | | |
| Monalube 205 | | | 5.56% | |
| TPS 20 | | | | 5.56% |
| Acticide EF[10] | 1.11% | 1.11% | 1.11% | 1.11% |

[8]Synperonic A11 is a C13/C15 monohydric alcohol initiated ethoxylate with 11 ethylene oxide units
[9]Synperonic A50 is a C13/C15 monohydric alcohol initiated ethoxylate with 50 ethylene oxide units
[10]Acticide EF is a biocide ex Thor Chemicals Table Eight illustrates the Falex machine Test B results for the above compositions, which have been diluted (by weight) with water.

TABLE EIGHT

| Lubricant Composition | Load At Failure (lbs.) |
|---|---|
| L1 diluted (1%) in water | 2341 |
| L2 diluted (1%) in water | 2847 |
| L3 diluted (1%) in water | 2600 |
| L4 diluted (1%) in water | >3000 |
| L1 diluted (5%) in water | >3000 |

The results indicate that water-based compositions of the present invention show enhanced lubricity.

EXAMPLE 5

The biodegradability of isopropyl benzoate and 2-ethylhexylbenzoate, both of which fall into the definition of formula (1) of the present invention, were measured over a 28 day period according to ISO Standard 14593 (modified OECD 301B). The results are shown in Table Nine.

TABLE NINE

| Ester | Biodegradability |
|---|---|
| isopropyl benzoate | 84% |
| 2-ethylhexyl benzoate | 88% |

The results compare favourably with Isopar H which is not biodegradable.

The invention claimed is:

1. A method of forming or cutting metal comprising:

lubricating the metal with a lubricant composition which comprises:

a) at least one compound of the formula (I):

$$R^1—(AO)_n—OOC—(CH_2)_m—Ph—(R^2)_p \quad (I)$$

where $R^1$ is a $C_1$ to $C_{15}$ alkyl group

AO is an alkyleneoxy group which may vary along the (poly)alkyleneoxy chain;

n is 0;

m is 0, 1 or 2;

Ph is a phenylene group, which may be substituted with groups $(R^2)_p$; where each $R^2$ is independently an alkyl, haloalky or alkoxy group; and p is 0 or from 1 to 3; and b) at least one lubricant additive selected from the group consisting of an organic ester additive, a polyalkylene glycol additive, a sulphur-containing synthetic additive, a sulphur-containing oleochemical additive, a sulphonate, a phosphorus-containing additive and a chlorinated paraffin additive, wherein the ratio of component (a) to component (b) ranges from 98:2 to 50:50; and forming or cutting the metal.

2. A method according to claim 1, wherein m and p are both 0.

3. A method according to claim 1, wherein the at least one compound of formula (1) is selected from the group consisting of 2-ethylhexyl benzoate, isobutyl benzoate or isopropyl benzoate.

4. A method of forming or cutting metal comprising:

lubricating the metal with a water-based solution which comprises a lubricant composition comprising:

a) at least one compound of the formula (I):

$$R^1—(AO)_n—OOC—(CH_2)_m—Ph—(R^2)_p \quad (I)$$

where $R^1$ is a $C_1$ to $C_{15}$ alkyl group

AO is an alkyleneoxy group which may vary along the (poly)alkyleneoxy chain;

n is 0;

m is 0, 1 or 2;

Ph is a phenylene group, which may be substituted with groups $(R^2)_p$; where each $R^2$ is independently an alkyl, haloalky or alkoxy group;

and p is 0 or from 1 to 3;

and b) at least one lubricant additive selected from the group consisting of an organic ester additive, a polyalkylene glycol additive, a sulphur-containing synthetic additive, a sulphur-containing oleochemical additive, a sulphonate, a phosphorus-containing additive and a chlorinated paraffin additive; and forming or cutting the metal.

5. A method according to claim 1, wherein the ratio of component (a) to component (b) ranges from 95:5 to 50:50.

6. A method according to claim 4, wherein the lubricating solution comprises 1-15% by weight of the lubricating composition.

7. A method of forming or cutting metal comprising:

lubricating the metal with a lubricant composition comprising:

a) at least one compound of the formula (I):

$$R^1—(AO)_n—OOC—(CH_2)_m—Ph—(R^2)_p \quad (I)$$

where $R^1$ is a $C_1$ to $C_{15}$ alkyl group

AO is an alkyleneoxy group which may vary along the (poly)alkyleneoxy chain;

n is 0;

m is 0, 1 or 2;

Ph is a phenylene group, which may be substituted with groups $(R^2)_p$; where each $R^2$ is independently an alkyl, halogen, haloalky or alkoxy group; and p is 0 or from 1 to 3;

and b) at least one lubricant additive selected from the group consisting of an organic ester additive, a polyalkylene glycol additive, a sulphur-containing synthetic additive, a sulphur-containing oleochemical additive, a sulphonate, a phosphorus-containing additive and a chlorinated paraffin additive;

wherein the ratio of component (a) to component (b) ranges from 98:2 to 50:50 and, when component (b) is a sulphonate, said ratio of component (a) to component (b) ranges from 95:5 to 50:50; and forming or cutting the metal.

8. A lubricant composition comprising:

a) at least one compound selected from the group consisting of 2-ethylhexyl benzoate, isobutyl benzoate or isopropyl benzoate; and b) at least one lubricant additive selected from the group consisting of an organic ester additive, a polyalkylene glycol additive, a sulphur-containing synthetic additive, a sulphur-containing oleochemical additive, a suiphonate, a phosphorus-containing additive and a chlorinated paraffin additive;

wherein the ratio of component (a) to component (b) ranges from 98:2 to 50:50.

9. A composition according to claim 8, wherein the ratio of component (a) to component (b) ranges from 95:5 to 50:50.

10. A water-based metal forming or cutting lubricant solution which comprises a lubricating composition comprising:

a) at least one compound of the formula (I):

$$R^1—(AO)_n—OOC—(CH_2)_m—Ph—(R^2)_p \quad (I)$$

where $R^1$ is a $C_1$ to $C_{15}$ alkyl group

AO is an alkyleneoxy group which may vary along the (poly)alkyleoneoxy chain;

n is 0;

m is 0, 1 or 2; and

Ph is a phenylene group, which may be substituted with groups $(R^2)_p$;

where each $R^2$ is independently an alkyl, haloalky or alkoxy group; and p is 0 or from 1 to 3:

and b) at least one lubricant additive selected from the group consisting of an organic ester additive, a polyalkylene glycol additive, a sulphur-containing synthetic additive, a sulphur-containing oleochemical additive, a sulphonate, a phosphorus-containing additive and a chlorinated paraffin additive.

11. A lubricating solution according to claim 10, wherein said solution comprises 1-15% by weight of the lubricating composition.

12. A lubricating composition comprising:

a) at least one compound of the formula (I):

$$R^1—(AO)_n—OOC—(CH_2)_m—Ph—(R^2)_p \quad (I)$$

where $R^1$ is a $C_1$ to $C_{15}$ alkyl group

AO is an alkyleneoxy group which may vary along the (poly)alkyleoneoxy chain;

n is 0;

m is 0, 1 or 2; and

Ph is a phenylene group, which may be substituted with groups $(R^2)^p$;

where each $R^2$ is independently an alkyl, haloalky or alkoxy group; and p is 0 or from 1 to 3:

and b) at least one lubricant additive selected from the group consisting of an organic ester additive, a polyalkylene glycol additive, a sulphur-containing synthetic additive, a sulphur-containing oleochemical additive, a sulphonate, a phosphorus-containing additive and a chlorinated paraffin additive;

wherein the ratio of component (a) to component (b) ranges from 98:2 to 50:50.

13. A composition according to claim 12, wherein the ratio of component (a) to component (b) ranges from 95:5 to 50:50.

14. A composition according to claim 12, wherein m and p are both 0.

* * * * *